US005549446A

United States Patent [19]

Gaston et al.

[11] Patent Number: 5,549,446

[45] Date of Patent: Aug. 27, 1996

[54] IN-TANK FUEL PUMP FOR HIGHLY VISCOUS FUELS

[75] Inventors: Robert D. Gaston, Dearborn Heights; DeQuan Yu, Ann Arbor, both of Mich.

[73] Assignee: Ford Motor Company, Dearborn, Mich.

[21] Appl. No.: 521,488

[22] Filed: Aug. 30, 1995

[51] Int. Cl.[6] ..... F04D 5/00

[52] U.S. Cl. ..... 415/55.1; 415/200; 415/215.1; 416/203

[58] Field of Search ..... 415/55.1, 200, 415/214.1, 215.1; 416/203

[56] References Cited

U.S. PATENT DOCUMENTS

| | | | |
|---|---|---|---|
| 2,042,499 | 6/1936 | Brady | 415/55.1 |
| 3,117,523 | 1/1964 | Jacobs . | |
| 3,127,840 | 4/1964 | Bochan . | |
| 3,751,179 | 8/1973 | Wassman . | |
| 3,773,432 | 11/1973 | Chow et al. . | |
| 4,881,871 | 11/1989 | Wunderlich | 416/203 |
| 4,923,365 | 5/1990 | Rollwage | 415/119 |
| 4,958,984 | 9/1990 | Aoi et al. | 415/55.1 |
| 5,123,809 | 6/1992 | Ito | 415/55.1 |
| 5,141,396 | 8/1992 | Schmidt et al. | 415/200 |
| 5,192,184 | 3/1993 | Nobuo et al. | 415/55.1 |
| 5,265,996 | 11/1993 | Westhoff et al. . | |
| 5,302,081 | 4/1994 | Smith | 415/55.1 |
| 5,407,318 | 4/1995 | Ito et al. | 415/55.1 |

*Primary Examiner*—Edward K. Look
*Assistant Examiner*—Michael S. Lee
*Attorney, Agent, or Firm*—Neil P. Ferraro

[57] ABSTRACT

A fuel pump for supplying diesel fuel to an engine includes a pump housing, a motor mounted within the housing, a shaft extending from the motor, an impeller slidably attached to the shaft which has a prime number of vanes spaced unevenly about its circumference, a chamber body, and a chamber cover with a bleed orifice. The chamber body and cover form a chamber for the impeller and are held together by the housing. The chamber body and cover have pump channels of constant depth and are made of phenolic with fiberglass fill. The impeller is made of phenolic with fiberglass fill and granular fill.

19 Claims, 2 Drawing Sheets

IN-TANK FUEL PUMP FOR HIGHLY VISCOUS FUELS

FIELD OF THE INVENTION

The present invention relates to fuel pumps, and, more particularly, to an in-tank fuel pump for pumping highly viscous fuels.

DESCRIPTION OF THE RELATED ART

Historically, diesel-fueled vehicles have used mechanical lift pumps located near the engine for supplying the engine with diesel fuel. By contrast, conventional gasoline engines have used regenerative turbine pumps located in the fuel tank for supplying spark-ignition engines with gasoline. While regenerative turbine pumps have many advantages for spark-ignition engines, they have not been widely used with diesel engines. This is because regenerative turbine pumps have traditionally been suited for providing high-flow, high-pressure fuel, whereas diesel engines require high-flow, low-pressure fuel. Furthermore, diesel fuel is more viscous than conventional gasoline, especially when cold, and is thus less inclined to flow smoothly. Diesel fuel also tends to cavitate or foam when hot, and sharp pressure rises, such as those which take place in regenerative turbine pumps, tend to aggravate this problem.

Several designers of diesel fuel systems have recently been attempting to replace mechanical lift pumps with non-regenerative in-tank electric DC fuel pumps, in order to improve fuel handling and extend pump life. Known as low pressure turbine paddle pumps, these pumps generally have large cells between individual impeller blades to improve the flow of viscous fuels and minimize pressure to conserve power. The present invention is directed at providing a low pressure, high flow turbine paddle pump which can maintain the necessary low pressure and high flow required to supply diesel fuel to a diesel engine while minimizing noise and maximizing efficiency.

SUMMARY OF THE INVENTION

A fuel pump for supplying diesel fuel to an engine includes a pump housing, a motor mounted within the housing, a shaft extending from the motor, an impeller slidably attached to the shaft which has a prime number of vanes spaced unevenly about its circumference, a chamber body, and a chamber cover with a bleed orifice. The chamber body and cover form a chamber for the impeller and are held together by the housing. The chamber body and cover have pump channels of constant depth and are made of phenolic with fiberglass fill. The impeller is made of phenolic with fiberglass fill and granular fill.

A primary object of the present invention is to provide a new and improved fuel pump for supplying fuel to a diesel engine. More specifically, it is an object of the present invention to provide improved pumping efficiency by reducing sharp changes in pressure.

A primary advantage of this invention is that it reduces cavitation. An additional advantage is that it maintains close tolerances without excessive machining of parts. A further advantage is that it reduces fuel pump noise.

Other objects, features, and advantages will be apparent from a study of the following written description and drawings.

DETAILED DESCRIPTION OF THE PREFERRED EMBODIMENTS

Figure 1:
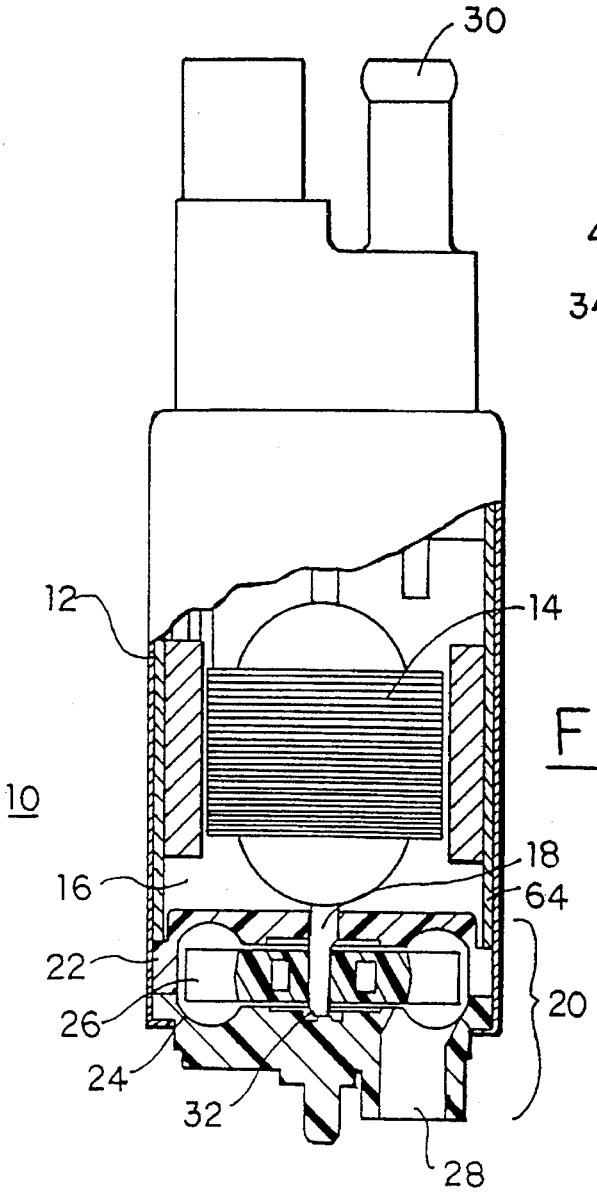
FIG. 1 is a fuel pump according to the present invention.

Referring now to FIG. 1, a fuel pump 10 includes a housing 12 for containing a motor 14, preferably a DC electric motor, within a motor space 16. Motor 14 has a shaft 18 extending therefrom in a direction from pump outlet 30 to pump inlet 28. Shaft 18 extends through pump chamber 20. Pump chamber 20 includes a chamber body 22 and a chamber cover 24 with an impeller 26 therebetween. Shaft 18 is preferably keyed to receive impeller 26 and rests against a shaft stop 32 in chamber cover 24. Shaft 18 is rotated by motor 14 and in turn rotates impeller 26 within pump chamber 20. Fuel is received through pump inlet 28 by rotation of impeller 26 and supplied to an engine via a fuel line (not shown) attached to pump outlet 30.

Figure 2:
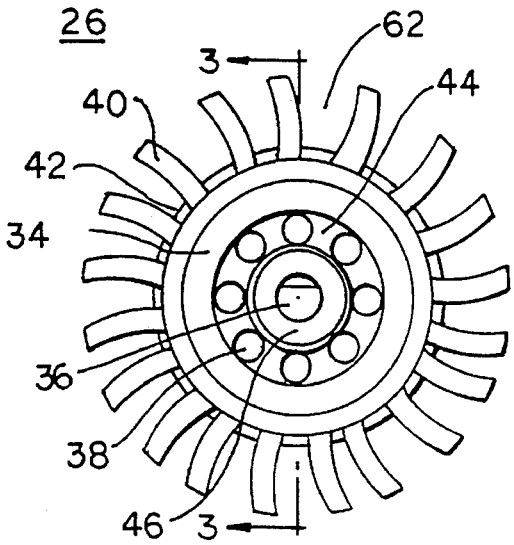
FIG. 2 is an impeller for a preferred embodiment of a fuel pump according to the present invention.

Referring now to FIG. 2, an impeller 26 for a preferred embodiment of a fuel pump 10 for pumping highly viscous fuels includes a central core 34 having a plurality of vanes 40 on its periphery. A parting line 42, or vane divider, runs between vanes 40 along the edge of central core 34, which is detailed in FIG. 3. Vanes 40 have vane wells 62 therebetween for scooping volumes of fuel received through pump inlet 28 and are curved, as detailed further in FIG. 4.

Continuing with FIG. 2, impeller 26 has a keyed center hole 36 for receiving shaft 18, upon which it free rides. Impeller 26 also has preferably at least one pressure relief hole 38 for permitting a relatively small flow of fuel through the impeller 26 during operation to equalize pressure, which prevents free-riding impeller 26 from tending to ride more towards chamber cover 24. Impeller 26 preferably has a prime number of unevenly spaced vanes 40 to minimize noise by, among other features, reducing the number of harmonic sound waves that can potentially be generated. Note that while a preferred embodiment includes unevenly spaced vanes 40, vane spacing is preferably selected such that the swept volume of each quarter, or ninety angular degrees, of impeller 26 is approximately equal for a particular quartering of impeller 26. This helps keep impeller 26 balanced and operating smoothly with minimal wobble.

Continuing with FIG. 2, impeller 26 is preferably made of phenolic, a thermoset-type plastic, with approximately twenty percent fiberglass fill and thirty percent granular fill, such as, for example, glass or graphite. Note that while the preferable fiberglass fill is twenty percent, it may range from ten to thirty percent. Also note that while the preferable granular fill is thirty percent, it may range from twenty to forty percent. Also note that the combined fiberglass and granular fill percentage should be in the range of forty to sixty percent. For the fundamental impeller material, phenolic is preferred because it is relatively stable and easily molded to provide close tolerances, and also because it can be cast at higher temperatures. Phenolic has good wear characteristics and can take added fills with ease and success. Fills, such as, for example, fiberglass, glass, and graphite, are preferred to improve fuel pump stability and wear.

Figure 3:
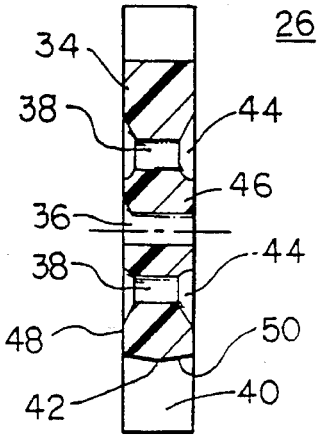
FIG. 3 is a cross-section of an impeller taken along lines 3—3 of FIG. 2.

Referring now to FIG. 3, a cross-section of an impeller 26 for a preferred embodiment of the present invention is shown. Central core 34 preferably has a circular central trough 44 on both sides with a raised portion 46 surrounding keyed center hole 36. Pressure relief holes 38 are preferably cylindrical in shape and provide a channel between sides of impeller 26 for permitting pressure to equalize. Vanes 40 are generally rectangular in profile, with adjacent vanes connected by parting line 42 which extends around the periphery of central core 34. Parting line 42 preferably represents the outermost circumferential extension of central core 34 such that a line perpendicular to impeller surface 48 and running through parting line 42 profile preferably intersects central core edge profile 50 at an angle of approximately six degrees. Angled edge profile 50 is useful for increasing centrifugal force and gaining mini-regenerative turbine pumping characteristics, which may be desirable for specific applications.

Figure 4:
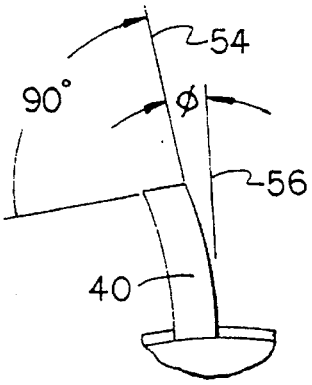
FIG. 4 is a close-up of an impeller vane for a preferred embodiment of a fuel pump according to the present invention.

Referring now to FIG. 4, a profile of an individual vane 40 for a preferred embodiment of the present invention reveals vane curvature. Vanes 40 may be straight or curved at an angle $\phi$. In a preferred embodiment, $\phi$ is between five and twenty degrees, with ten degrees being preferable. Note that angle $\phi$ is defined as the angle made by the intersection of a perpendicular to vane outer edge 54 with a perpendicular 56 to central core 34. Curved vanes 40 are preferable because they provide greater pump efficiency. Vanes 40 are generally of greater thickness than those used in, for example, regenerative turbine gasoline fuel pumps, because vanes 40 must move diesel fuel, which is of greater viscosity. For example, in a preferred embodiment with an impeller 26 of 29.63 mm diameter and 5.3 mm height, vanes 40 are nineteen in number and of 1.5 mm thickness.

Figure 5:
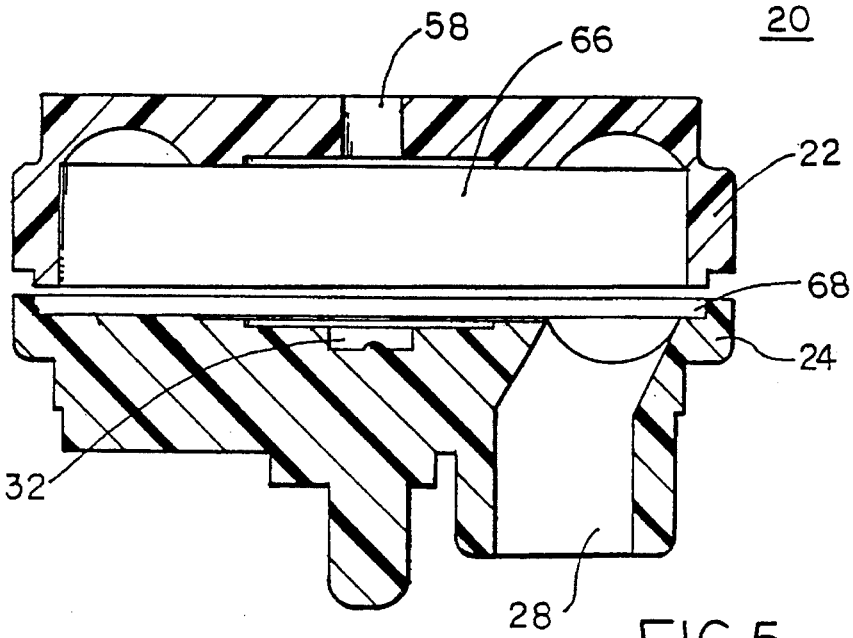
FIG. 5 is a pumping chamber for a preferred embodiment of a fuel pump according to the present invention.

Referring to FIG. 5, pump chamber 20 for a preferred embodiment of a fuel pump according to the present invention includes chamber body 22 and chamber cover 24. Chamber body 22 includes a bearing hole 58 through which shaft 18 extends. Impeller 26 (not shown) rotates on shaft 18 within central hollow 66 created by the interlocking of chamber body 22 with chamber cover 24. Chamber cover 24 has an interlocking lip 68 for mating at close tolerances with chamber body 22 to provide a relatively tight seal that need not be machined. Chamber cover 24 includes shaft stop 32 for guiding the rotation of shaft 18 to provide stability. Note that pump channels 70, 72 of chamber body 22 and chamber cover 24 are preferably of constant depth and no ramping is provided, in order to minimize unnecessary increases in fuel pressure.

Continuing with FIG. 5, chamber body 22 and chamber cover 24 are preferably made of phenolic with twenty percent fiberglass fill to reduce warping during part cooling. Note that while the preferable fiberglass fill is twenty percent, it may range from ten to thirty percent. Also, note that unlike impeller 26, chamber body 22 and cover 24 do not contain granular fill. This is because chamber body 22 is used as a bearing for shaft 18. Chamber cover 24 and chamber body 22 are preferably keyed 74 for proper alignment of pump inlet 28 and chamber outlet 60. Once chamber cover 24 and chamber body 22 have been fitted over impeller 26 and interlocked to create pump chamber 20, pump chamber 20 is placed inside housing 18 against housing stop 64 and held in place by crimping the housing 18 against pump chamber 20, as shown in FIG. 1.

Figure 6:
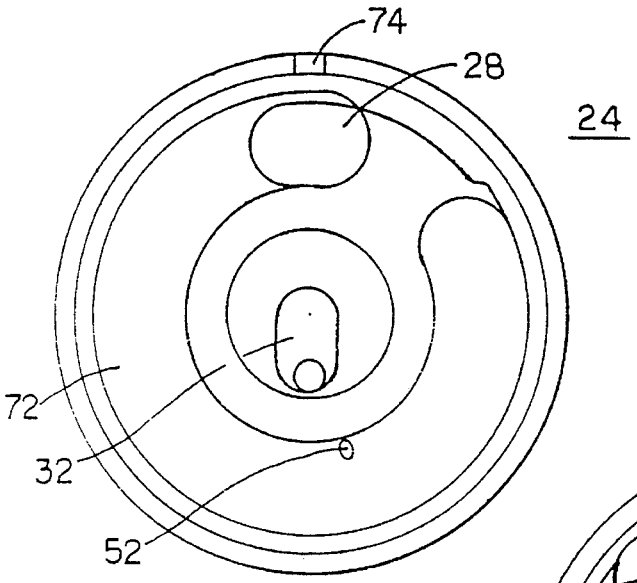
FIG. 6 is the interior of a pumping chamber cover taken along lines 6—6 of FIG. 5.

Referring now to FIG. 6, the interior of chamber cover 24 for a preferred embodiment of the present invention is shown to demonstrate the preferable geometry of the chamber cover pump channel 72. Note that cover pump channel 72 is of constant depth, with no narrowing or incline of the walls throughout and no ramping. These could be utilized, but a preferred embodiment omits them because they are typically used to build pressure and pressure is not desired in the instant situation. Similarly, note that pump inlet 28 preferably has a shortened entrance with no ramping. This is because fuel pump 10 operates on the paddle wheel principle, in which impeller 26 (not shown) scoops liquid fuel from pump inlet 28 and provides it to chamber outlet 60. Vapor bleed orifice 52 is preferably positioned between 170 and 180 angular degrees from pump inlet 28. Vapor bleed orifice 52 is for bleeding fuel vapor out of pump chamber 20 before vapor reaches chamber outlet 60, which is essential for proper operation. Note that because pump cover 24 is preferably made of phenolic with 20% fiberglass fill, it has less boundary layer friction when fluid flows over it and serves as a bearing for shaft 18. Chamber cover 24 has a key notch 74 for proper orientation with chamber body 22.

Figure 7:
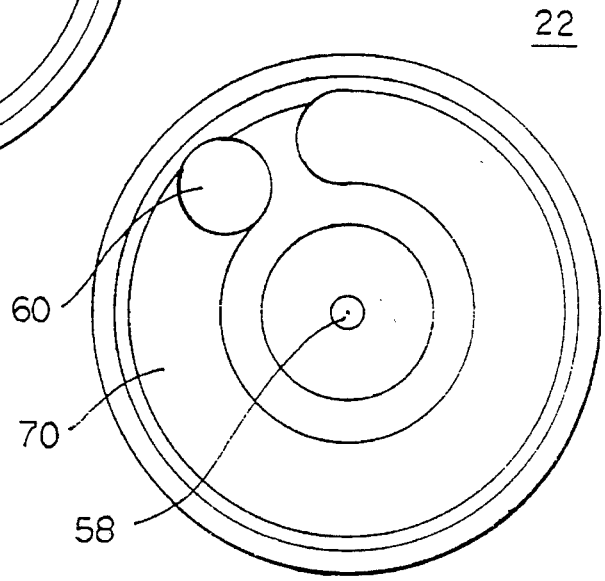
FIG. 7 is the interior of a pumping chamber body taken along lines 7—7 of FIG. 5.

Turning finally to FIG. 7, the interior of chamber body 22 for a preferred embodiment of the present invention is shown to demonstrate the preferable geometry of the chamber body pump channel 70. Note that chamber body pump channel 70 is of constant depth, with no narrowing or incline of the walls throughout and no ramping. These could be utilized, but a preferred embodiment omits them because they are typically used to build pressure and pressure is not desired in the instant situation. Similarly, note that chamber outlet 60 preferably has a short egress, which may be angled by, for example, forty-five degrees, in order to improve pump efficiency by reducing fuel turbulence.

From the foregoing description, one ordinarily skilled in the art can easily ascertain the essential characteristics of this invention and, without departing from the spirit and scope of the claims, can make various changes and modifications to the invention to adapt it to various uses and conditions.

We claim:

1. A fuel pump for supplying diesel fuel to an engine, comprising:

a pump housing;

a motor mounted within said housing;

a shaft extending from said motor;

an impeller slidably attached to said shaft and having a prime number of vanes spaced unevenly about a circumference thereof;

a chamber body mounted within an end of said housing, said chamber body having a bore, a chamber body pump channel, and a chamber outlet, wherein said shaft extends through the bore and said impeller rotates within the chamber body pump channel; and a chamber cover engaging said chamber body and being held by said housing, said chamber cover having an interlocking lip and a key notch for engaging said chamber body, a bleed orifice, a chamber cover pump channel and a shaft stop, said impeller being rotatable within the chamber cover pump channel, and an end of said shaft being rotatable against the shaft stop.

2. A fuel pump as in claim 1, wherein said chamber body and said chamber cover are comprised of phenolic with fiberglass fill.

3. A fuel pump as in claim 2, wherein said chamber body and said chamber cover are comprised of phenolic with ten to thirty-percent fiberglass fill.

4. A fuel pump as in claim 3, wherein said chamber body and said chamber cover are comprised of phenolic with approximately twenty percent fiberglass fill.

5. A fuel pump as in claim 1, wherein said impeller is comprised of phenolic with fiberglass fill and granular fill.

6. A fuel pump as in claim 5, wherein said impeller is comprised of phenolic with ten to thirty percent fiberglass fill and twenty to forty percent granular fill.

7. A fuel pump as in claim 6, wherein said impeller is comprised of phenolic with approximately twenty percent fiberglass fill and approximately thirty percent granular fill.

8. A fuel pump as in claim 7, wherein said granular fill is comprised of glass.

9. A fuel pump as in claim 7, wherein said granular fill is comprised of graphite.

10. A fuel pump as in claim 1, wherein said vanes are curved in the direction of rotation.

11. A fuel pump as in claim 10, wherein said vanes are curved to define a vane curve angle of five to twenty degrees between a perpendicular to an outer edge of said vane and a perpendicular to a central core of said impeller.

12. A fuel pump as in claim 11 wherein said vane curve angle is ten degrees.

13. A fuel pump as in claim 1 wherein the chamber body pump channel is of uniform depth.

14. A fuel pump as in claim 1 wherein the chamber cover pump channel is of uniform depth.

15. A fuel pump as in claim 1 wherein said unevenly spaced vanes define a constant swept volume per a quarter of a circumference of said impeller for a particular quartering thereof.

16. A fuel pump for supplying diesel fuel to an engine, comprising:

a pump housing;

a motor mounted within said housing;

a shaft extending from said motor;

an impeller slidably attached to said shaft and having a prime number of vanes spaced unevenly about a circumference thereof, said vanes defining a constant swept volume per a quarter of a circumference of said impeller for a particular quartering thereof, said vanes being curved in the direction of rotation to define a vane curve angle of five to twenty degrees between a perpendicular to an outer edge of said vane and a perpendicular to a central core of said impeller;

a chamber body mounted within an end of said housing, said chamber body having a bore, a chamber body pump channel of uniform depth, and a chamber outlet, wherein said shaft extends through the bore and said impeller rotates within the chamber body pump channel; and a chamber cover engaging said chamber body and being held by said housing, said chamber cover having an interlocking lip and a key notch for engaging said chamber body, a bleed orifice, a chamber cover pump channel of uniform depth, and a shaft stop, said impeller being rotatable within the chamber cover pump channel, and an end of said shaft being rotatable against the shaft stop.

17. A fuel pump as in claim 16, wherein said chamber body and said chamber cover are comprised of phenolic with approximately twenty percent fiberglass fill.

18. A fuel pump as in claim 16, wherein said impeller is comprised of phenolic with approximately twenty percent fiberglass fill and approximately thirty percent granular fill.

19. A fuel pump as in claim 16 wherein said vane curve angle is ten degrees.

* * * * *